US012305349B2

(12) United States Patent
Niroumand et al.

(10) Patent No.: US 12,305,349 B2
(45) Date of Patent: May 20, 2025

(54) LIFTING AND REPAIRING FOUNDATIONS

(71) Applicants: Bahman Niroumand, Bushehr (IR); Kimiya Niroumand, Bushehr (IR)

(72) Inventors: Bahman Niroumand, Bushehr (IR); Kimiya Niroumand, Bushehr (IR)

( * ) Notice: Subject to any disclaimer, the term of this patent is extended or adjusted under 35 U.S.C. 154(b) by 208 days.

(21) Appl. No.: 18/309,790

(22) Filed: Apr. 29, 2023

(65) Prior Publication Data

US 2023/0265638 A1 Aug. 24, 2023

Related U.S. Application Data

(60) Provisional application No. 63/337,103, filed on May 1, 2022.

(51) Int. Cl.
*E02D 35/00* (2006.01)

(52) U.S. Cl.
CPC ..... *E02D 35/005* (2013.01); *E02D 2250/003* (2013.01); *E02D 2300/0023* (2013.01); *E02D 2300/0079* (2013.01)

(58) Field of Classification Search
CPC ..... E02D 35/00; E02D 35/005
USPC ..... 405/230
See application file for complete search history.

(56) References Cited

U.S. PATENT DOCUMENTS 5,013,190 A * 5/1991 Green ..... E02D 35/00 405/230
5,154,539 A * 10/1992 McCown, Sr. ..... E04G 23/065 405/230
5,176,472 A * 1/1993 Kinder ..... E02D 35/00 405/230
5,234,287 A * 8/1993 Rippe, Jr. ..... E02D 27/48 405/230
5,246,311 A * 9/1993 West ..... E02D 35/00 405/230
5,575,591 A * 11/1996 Vanderklaauw ..... E04G 1/14 405/230
5,904,446 A * 5/1999 Carlinsky ..... E02D 27/32 52/169.9
6,379,085 B1 * 4/2002 Vanderklaauw ..... E04G 1/17 405/230
6,808,338 B2 * 10/2004 Zingerman ..... B66F 7/20 405/230
6,951,437 B2 * 10/2005 Hall ..... E02D 27/48 405/253

(Continued)

*Primary Examiner* — Frederick L Lagman

(57) ABSTRACT

A method for lifting and repairing a foundation is disclosed. The method includes digging a well in at least one lateral surface of the foundation, installing a shear plate to the at least one lateral surface of the foundation inside the opening of the well, further digging the well to a maximum depth of 6 m, compacting a bottom surface of the well at the maximum depth of 6 m, forming a layer of gravel, compacting the layer of the gravel, placing a double column inside the well, pouring a plurality of gravel particles into the well, forming a cemented gravel layer by injecting cement slurry into the well to fill empty spaces among the plurality of gravel particles, installing a tensile system on top of the double column, forming at least a vacant space between the foundation and ground by lifting the foundation from the ground using the tensile system, and fixing the foundation by injecting cement slurry into the vacant space.

18 Claims, 18 Drawing Sheets

(56) References Cited

U.S. PATENT DOCUMENTS

| | | | | |
|---|---|---|---|---|
| 7,556,453 | B2 * | 7/2009 | Collina | E02D 5/28 405/230 |
| 7,857,549 | B1 * | 12/2010 | Deshazer | E02D 35/00 405/250 |
| 8,714,880 | B1 * | 5/2014 | Mitchell | E02D 35/005 405/230 |
| 11,732,434 | B2 * | 8/2023 | Cui | E02D 27/34 405/230 |

* cited by examiner

230

250

LIFTING AND REPAIRING FOUNDATIONS

CROSS-REFERENCE TO RELATED APPLICATION

This application claims the benefit of priority from U.S. Provisional Patent Application Ser. No. 63/337,103, filed May 1, 2022, and entitled "THE PROCESS OF LIFTING AND REPAIRING INDUSTRIAL AND CONSTRUCTION CONCRETE FOUNDATIONS USING COMPOSITE CEMENTED AGGREGATE PIERS" which is incorporated herein by reference in its entirety.

TECHNICAL FIELD

The present disclosure generally relates to a method of lifting and repairing foundations, and more particularly, relates to a method of lifting and repairing industrial-building foundations and construction foundations using cemented gravel particles.

BACKGROUND

Foundation of a building or a structure is the lowest part of a building or a structure which is directly in contact with ground soil. Foundations transfer dynamic and static loads from a building or a structure to soil. There are different factors damaging foundations such as water damage, shifting soil, soil erosion, sinkhole formations, improper constructions, static loads, and dynamic loads. Static and dynamic loads are two important factors that damage foundations which can cause closure of buildings and structures.

For repairing damaged foundations, conventionally different strategies are often applied. These strategies include slab jacking and hydraulic jacking. Foundations can be repaired using Slab jacking (or mud jacking) method which is based on pumping a grout mixture or foam beneath foundations. Hydraulic jacks which work based on applying a force via a hydraulic cylinder can also be used as lifting instruments.

Repairing damaged foundations using slab jacking and hydraulic jacking have multiple limitations. These limitations include requiring heavy and bulky equipment, a prolonged repairing process, and a network of facility channels at bottom of structures and buildings. A prolonged repairing foundations process may impose a huge financial burden on employers and presence of facility channels at bottom of structures and buildings may be challenging for common conventional methods of repairing foundations due to possible damage to facility channels.

There is, therefore, a need for a method to lift and repair foundations of a building and a structure without damaging buildings and structures. There is further a need for a light and reusable device for lifting and repairing foundations of a building and/or a structure.

SUMMARY

This summary is intended to provide an overview of the subject matter of the present disclosure and is not intended to identify essential elements or key elements of the subject matter, nor is it intended to be used to determine the scope of the claimed implementations. The proper scope of the present disclosure may be ascertained from the claims set forth below in view of the detailed description and the drawings.

According to one or more exemplary embodiments, the present disclosure is directed to a method for lifting and repairing a foundation. In an exemplary embodiment, an exemplary method may include digging a well below at least one lateral surface of an exemplary foundation in which at least one third of an opening of an exemplary well may be covered by a part of an exemplary foundation, installing a shear plate to an exemplary at least one lateral surface of an exemplary foundation inside an exemplary opening of an exemplary well, further digging an exemplary well to a depth of maximum 6 m, compacting bottom surface of an exemplary well at an exemplary maximum depth of 6 m by dynamic hammering an exemplary bottom surface of an exemplary well, forming a layer of gravel by pouring a first plurality of gravel particles inside an exemplary well, compacting an exemplary layer of an exemplary gravel by dynamic hammering an exemplary layer of an exemplary gravel, placing a double column inside an exemplary well in which an exemplary double column may be fixed to an exemplary shear plate, pouring a second plurality of gravel particles into an exemplary well in which an exemplary plurality of gravel particles may fill around an exemplary double column in an exemplary well, forming a cemented gravel layer by injecting a first amount of cement slurry into an exemplary well to fill empty spaces among an exemplary second plurality of gravel particles, installing a tensile system on top of an exemplary double column in which an exemplary tensile system may be fixed on an exemplary shear plate, forming at least a vacant space between an exemplary foundation and ground by lifting an exemplary foundation from an exemplary ground using an exemplary tensile system, and fixing an exemplary foundation by injecting a second amount of cement slurry into an exemplary at least a vacant space.

In an exemplary embodiment, fixing an exemplary foundation may further include pouring a third plurality of gravel particles into an exemplary well in which an exemplary third plurality of particles may fill an exemplary well.

In an exemplary embodiment, fixing an exemplary foundation may further include pouring a third amount of cement slurry into an exemplary well in which an exemplary third amount of cement slurry may fill empty spaces among an exemplary second plurality of gravel particles.

In an exemplary embodiment, digging an exemplary well in at least one lateral surface of an exemplary foundation may include digging an exemplary well with a diameter in a range of 1 m to 1.5 m. In an exemplary embodiment, digging an exemplary well in at least one lateral surface of an exemplary foundation may include digging an exemplary well with a depth of maximum 6 m.

In an exemplary embodiment, digging an exemplary well in at least one lateral surface of an exemplary foundation may include digging an exemplary well with at least 30 cm of an exemplary opening of an exemplary well may be covered by an exemplary foundation.

In an exemplary embodiment, installing an exemplary shear plate may include installing an exemplary shear plate to an exemplary at least one lateral surface of an exemplary foundation inside an exemplary opening of an exemplary well with one lateral surface of an exemplary shear plate being equal to a thickness of an exemplary foundation.

In an exemplary embodiment, installing an exemplary shear plate to an exemplary at least one lateral surface of an exemplary foundation may include inserting at least six tie rods of an exemplary shear plate into an exemplary foundation.

In an exemplary embodiment, an exemplary method may further include fixing an exemplary double column to an exemplary shear plate by welding an exemplary double column to an exemplary shear plate.

In an exemplary embodiment, forming an exemplary layer of gravel may include pouring an exemplary first plurality of gravel particles inside an exemplary well with a thickness of an exemplary layer of gravel in a range of 20 cm to 80 cm.

In an exemplary embodiment, compacting an exemplary layer of an exemplary gravel may include hammering an exemplary layer of an exemplary gravel using a hammer with a weight of an exemplary hammer in a range of 30 kg to 50 kg.

In an exemplary embodiment, compacting an exemplary layer of an exemplary gravel may include hammering an exemplary layer of an exemplary gravel using an exemplary hammer with a speed of hammering in a range of 800 blow per minute to 1100 blow per minute. In an exemplary embodiment an exemplary hammer may be an electric hammer.

In an exemplary embodiment, installing an exemplary double column inside an exemplary well may include fixing an exemplary double column to an exemplary layer of an exemplary gravel and an exemplary shear plate using an exemplary cemented gravel layer filling around an exemplary double column in which an exemplary double column may be made of steel.

In an exemplary embodiment, pouring an exemplary second plurality of gravel particles may include pouring an exemplary second plurality of gravel particles with a distance up to 70 cm between a top surface of an exemplary second plurality of gravel particles and an exemplary foundation. In an exemplary embodiment, each gravel particle of an exemplary second plurality of gravel particles may have an average particle size in a range of 12 mm to 38 mm.

In an exemplary embodiment, installing an exemplary tensile system on top of an exemplary double column may include installing a jack and a tensile shaft on top of an exemplary double column in which an exemplary tensile shaft may be aligned parallel with an exemplary double column. In an exemplary embodiment, installing an exemplary tensile system on top of an exemplary double column may include installing a jack and a tensile shaft on top of an exemplary double column in which an exemplary tensile shaft may be connected to an exemplary jack.

In an exemplary embodiment, injecting an exemplary second amount of cement slurry into an exemplary at least a vacant space between an exemplary cemented gravel layer and an exemplary foundation may include forming at least two holes in an exemplary foundation and injecting an exemplary second amount of cement slurry through an exemplary at least two holes into an exemplary at least a vacant space between an exemplary cemented gravel layer and an exemplary foundation. In an exemplary embodiment, lifting an exemplary foundation may include lifting an exemplary foundation from at least one side of an exemplary foundation.

BRIEF DESCRIPTION OF THE DRAWINGS

The novel features which are believed to be characteristic of the present disclosure, as to its structure, organization, use and method of operation, together with further objectives and advantages thereof, will be better understood from the following drawings in which a presently preferred embodiment of the present disclosure will now be illustrated by way of example. It is expressly understood, however, that the drawings are for illustration and description only and are not intended as a definition of the limits of the present disclosure. Embodiments of the present disclosure will now be described by way of example in association with the accompanying drawings in which.

DETAILED DESCRIPTION

Figure 1A:
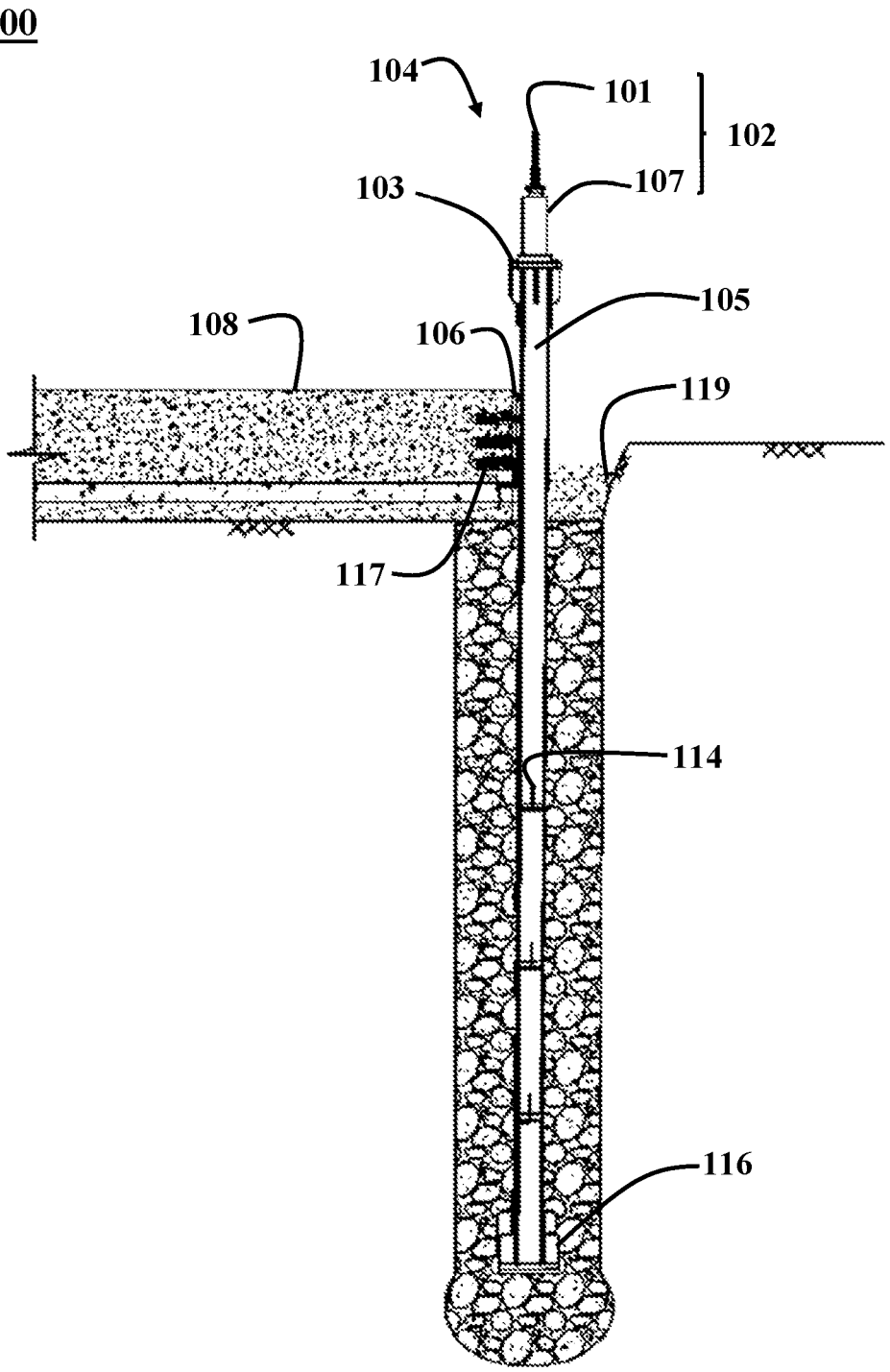
FIG. 1A illustrates a side view of a device for lifting and repairing a foundation, consistent with one or more exemplary embodiments of the disclosure.

The novel features which are believed to be characteristic of the present disclosure, as to its structure, organization, use and method of operation, together with further objectives and advantages thereof, will be better understood from the following discussion.

The novel features which are believed to be characteristic of the present disclosure, as to its structure, organization, use and method of operation, together with further objectives and advantages thereof, will be better understood from the following discussion. In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings. The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be readily apparent to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

The present disclosure is directed to exemplary embodiments of a method for lifting and repairing a foundation of a building and/or a structure and a device to use thereof. In an exemplary embodiment, an exemplary device may be installed in ground. In an exemplary embodiment, an exemplary device may be used multiple times. In an exemplary embodiment, an exemplary device may be made of steel. In an exemplary embodiment, an exemplary device may lift an exemplary foundation. In an exemplary embodiment, a plurality of exemplary devices may be used for aligning an exemplary foundation.

In an exemplary embodiment, an exemplary method of lifting and repairing foundations may include installing an exemplary device inside a well. In an exemplary embodiment, an exemplary well may be a hole dug in a ground. In an exemplary embodiment, at least one third of an opening of an exemplary well may be covered by a part of an exemplary foundation. In an exemplary embodiment, an exemplary well may be dug below at least one side of an exemplary foundation. In an exemplary embodiment, after digging an exemplary well to a depth of maximum 6 m, a shear plate may be installed on a lateral surface of an exemplary foundation inside an exemplary well. In an exemplary embodiment, after installing an exemplary shear plate on an exemplary lateral surface of an exemplary foundation, an exemplary well may be dug further to a depth of maximum 6 m. In an exemplary embodiment, after reaching to a depth of maximum 6 m, a dynamic hammer may be used to compact a bottom surface of well 119 at an exemplary depth of maximum 6 m. In an exemplary embodiment, an exemplary dynamic hammer may be used in a vertical direction. In an exemplary embodiment, after compacting an exemplary bottom surface of well 119 at an exemplary depth of maximum 6 m, a layer of gravel may be formed by pouring a first plurality of gravel particles inside an exemplary well. In an exemplary embodiment, after pouring an exemplary first plurality of gravel particles, a dynamic hammer may be used to compact an exemplary layer of gravel in a vertical direction. In an exemplary embodiment, after compacting an exemplary layer of gravel, a pressure transfer column may be placed inside an exemplary well. In an exemplary embodiment, an exemplary pressure transfer column may be fixed to an exemplary shear plate. In an exemplary embodiment, an exemplary pressure transfer column may include a double column, a top stiffening plate, a bottom stiffening plate, a plurality of shear connections, and a plurality of parallel clamps.

In an exemplary embodiment, a second plurality of gravel particles may be poured inside an exemplary well. In an exemplary embodiment, an exemplary second plurality of gravel particles may be filled around an exemplary pressure transfer column in an exemplary well. In an exemplary embodiment, a cemented gravel layer may be formed by injecting a first amount of cement slurry into an exemplary second plurality of gravel particles. In an exemplary embodiment, a distance between an exemplary cemented gravel layer and an exemplary foundation may be up to 70 cm. In an exemplary embodiment, a tensile system may be installed on top of an exemplary pressure transfer column.

In an exemplary embodiment, an exemplary tensile system may be fixed on an exemplary shear plate. In an exemplary embodiment, an exemplary tensile system may include a jack and a tensile shaft. In an exemplary embodiment, an exemplary jack may be a hydraulic jack. In an exemplary embodiment, an exemplary tensile system may be used to lift an exemplary foundation to a desired height. In an exemplary embodiment, an exemplary foundation may be lifted from at least one side of an exemplary foundation. In an exemplary embodiment, an exemplary foundation may be lifted from at least two lateral sides of an exemplary foundation, simultaneously. In an exemplary embodiment, an exemplary foundation may be lifted from at least two lateral sides of an exemplary foundation, respectively. In an exemplary embodiment, at least a vacant space may form between an exemplary foundation and ground below an exemplary foundation. In an exemplary embodiment, an exemplary at least a vacant space may be filled with a second amount of cement slurry. In an exemplary embodiment, an exemplary second amount of cement slurry may be injected into an exemplary at least a vacant space. In an exemplary embodiment, injecting an exemplary second amount of cement slurry into an exemplary at least a vacant space may include forming at least two holes in an exemplary foundation. In an exemplary embodiment, an exemplary at least two holes may be formed in an exemplary foundation above an exemplary at least a vacant space. In an exemplary embodiment, an exemplary foundation may be fixed by injecting an exemplary second amount of cement slurry into an exemplary at least a vacant space through exemplary at least two holes. In an exemplary embodiment, an exemplary foundation may further be fixed by pouring a third plurality of gravel particles into an exemplary well in which an exemplary third plurality of gravel particles may fill an exemplary well. In an exemplary embodiment, after pouring an exemplary third plurality of gravel particles into an exemplary well, a third amount of cement slurry may be poured into an exemplary well. In an exemplary embodiment, an exemplary third amount of cement slurry may fill empty spaces among an exemplary third plurality of gravel particles.

FIG. 1A illustrates a side view 100 of a device 104 for lifting and repairing foundation 108, consistent with one or more exemplary embodiments of the disclosure. In an exemplary embodiment, device 104 may include a pressure transfer column 105, a tensile system 102, and a shear plate 106 installed in well 119. In an exemplary embodiment, pressure transfer column 105 may include top stiffening plate 103, bottom stiffening plate 116, a plurality of tie rods 117, and a plurality of shear connections 114. In an exemplary embodiment, an exemplary plurality of tie rods 117 may be inserted into foundation 108. In an exemplary embodiment, an exemplary plurality of tie rods 117 may fix shear plate 106 in foundation 108. In an exemplary embodiment, tensile system 102 may include a jack 107 and a tensile shaft 101. In an exemplary embodiment, jack 107 may be a hydraulic jack. In an exemplary embodiment, tensile system 102 may be implanted on top of pressure transfer column 105. In an exemplary embodiment, tensile system 102 may be connected to shear plate 106. In an exemplary embodiment, tensile shaft 101 may pass through shear plate 106. In an exemplary embodiment, device 104 may be used to lift and repair foundation 108. In an exemplary embodiment, foundation 108 may be at least a foundation of a building, a foundation of a structure, and combinations thereof. In an exemplary embodiment, foundation 108 may be a load-bearing part of a building or a structure. In an exemplary embodiment, plurality of shear connections 114 may be placed on pressure transfer column 105 at a respective set of pre-determined heights of pressure transfer column 105. In further detail, plurality of shear connections 114 may be placed at a distance relative to each other in a range of 50 cm to 100 cm (in context of pre-determined heights) on pressure transfer column 105. In an exemplary embodiment, an exemplary plurality of shear connections 114 may be used to fix pressure transfer column 105 in ground. In an exemplary embodiment, an exemplary plurality of shear connections 114 may form a jagged-shaped pressure transfer column 105. In an exemplary embodiment, an exemplary plurality of shear connections 114 may fix pressure transfer column 105 in ground during a lifting process of foundation 108.

Figure 1B:
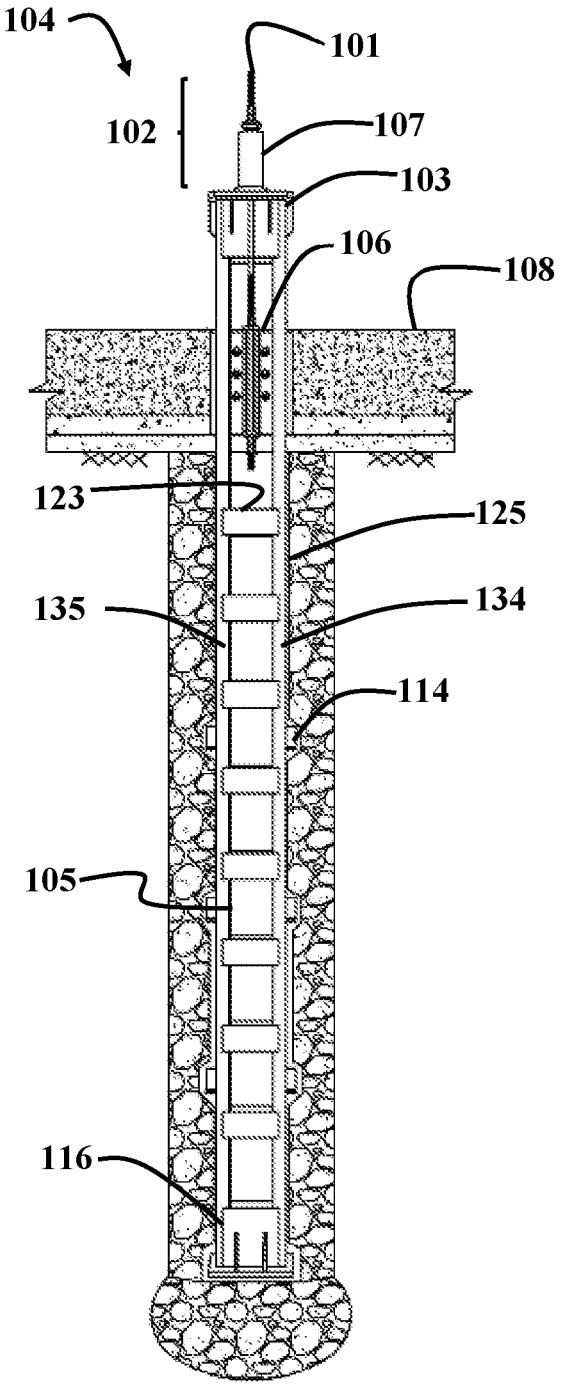
FIG. 1B illustrates a front view of a device for lifting and repairing a foundation, consistent with one or more exemplary embodiments of the disclosure.

FIG. 1B illustrates a front view 120 of device 104 for lifting and repairing foundation 108, consistent with one or more exemplary embodiments of the disclosure. In an exemplary embodiment, device 104 may include a pressure transfer column 105, tensile system 102, and shear plate 106. In an exemplary embodiment, pressure transfer column 105 may include a double column 125, a plurality of parallel clamps 123, a plurality of shear connections 114, a top stiffening plate 103, and a bottom stiffening plate 116. In an exemplary embodiment, top stiffening plate 103 may be welded to double column 125. In an exemplary embodiment, tensile system 102 may include jack 107 and tensile shaft 101. In an exemplary embodiment, double column 125 may include a first column 134 and a second column 135. In an exemplary embodiment, first column 134 and second column 135 may be attached to each other using an exemplary plurality of parallel clamps 114. In an exemplary embodiment, device 104 may be used to lift and repair foundation 108. In an exemplary embodiment, shear connection 114 may be used to fix double column 125 in ground.

Figure 1C:
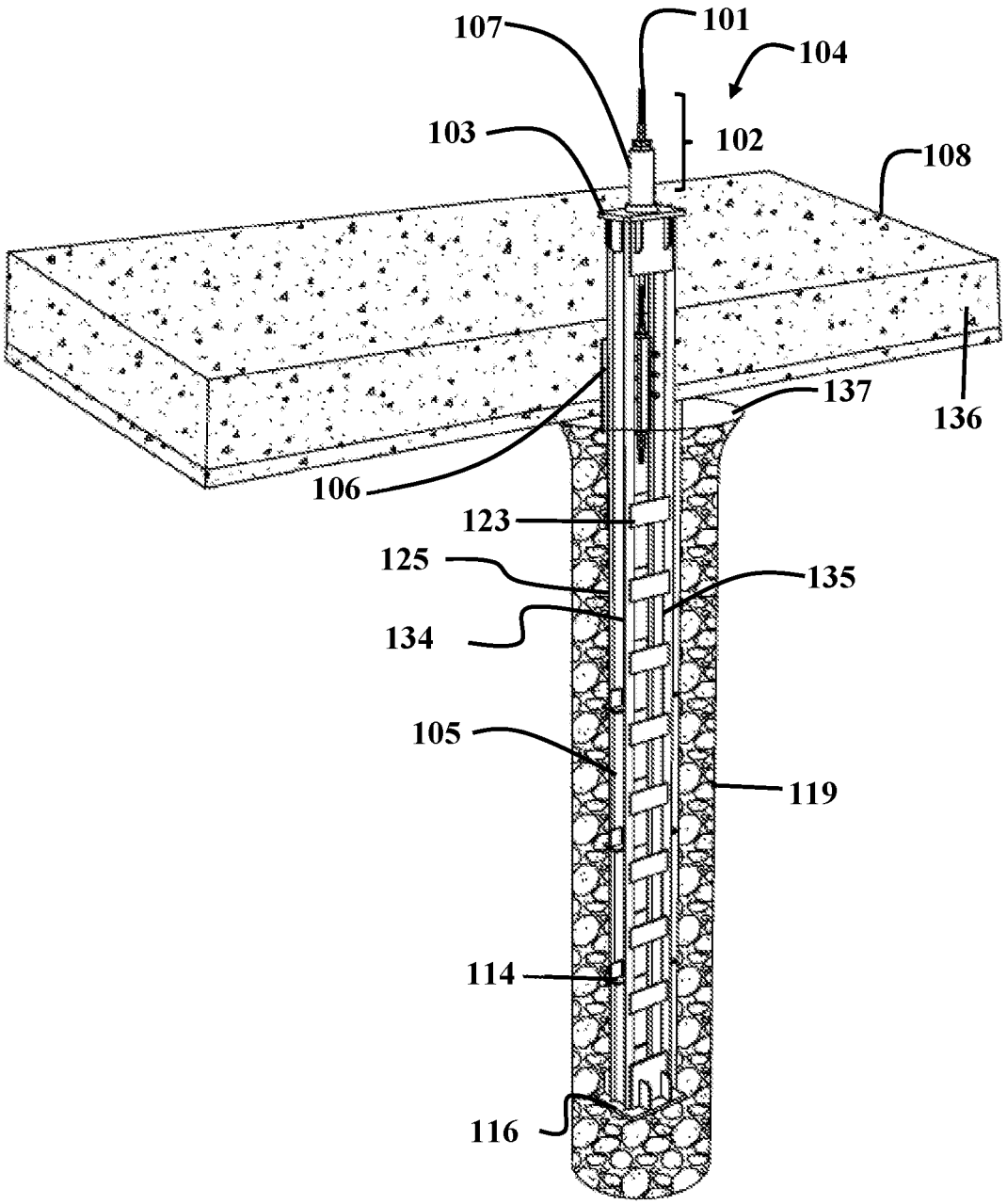
FIG. 1C illustrates a perspective view of a device for lifting and repairing a foundation, consistent with one or more exemplary embodiments of the present disclosure.

FIG. 1C illustrates a perspective view 140 of device 104 for lifting and repairing foundation 108, consistent with one or more exemplary embodiments of the present disclosure. In an exemplary embodiment, device 104 may include a pressure transfer column 105, a tensile system 102, and a shear plate 106. In an exemplary embodiment, shear plate 106 may be attached to lateral surface 136 of foundation 108 inside opening 137 of well 119. In an exemplary embodiment, pressure transfer column 105 may include a double column 125, top stiffening plate 103, a plurality of shear connection 114, and bottom stiffening plate 116, and a plurality of parallel clamps 123. In an exemplary embodiment, tensile system 102 may include a jack 107 and a tensile shaft 101. In an exemplary embodiment, jack 107 may include a hydraulic jack. In an exemplary embodiment, tensile system 101 may be used to lift foundation 108. In an exemplary embodiment, double column 125 may include a first column 134 and a second column 135. In an exemplary embodiment, first column 134 and second column 135 may be parallel. In an exemplary embodiment, first column 134 and second column 135 may be made of steel. In an exemplary embodiment, an exemplary plurality of parallel clamps 123 may be used to fix first column 134 and second column 135 together. In an exemplary embodiment, an exemplary plurality of parallel clamps 123 may be made of steel. In an exemplary embodiment, shear connection 114 may be used to fix double column 125 in ground. In an exemplary embodiment, bottom stiffening plate 116 may be installed on bottom of double column 125. In an exemplary embodiment, bottom stiffening plate 116 may be installed on double column 125 by at least using a plurality of bolts and nuts, welding bottom stiffening plate 116 to double column 125, and combinations thereof. In an exemplary embodiment, bottom stiffening plate 116 may be used as a base for holding double column 125 using at least a plurality of bolts and nuts, welding bottom stiffening plate 116 to double column 125, and combinations thereof. In an exemplary embodiment, bottom stiffening plate 116 may be used as a base for placing double column 125 on an exemplary bottom surface of well 119. In an exemplary embodiment, top stiffening plate 103 may be implanted on top of double column 125. In an exemplary embodiment, top stiffening plate 103 may be used to fix first column 134, second column 135, and tensile system 102 together. In an exemplary embodiment, tensile system 102 may be installed on top of double column 125.

Figure 2A:
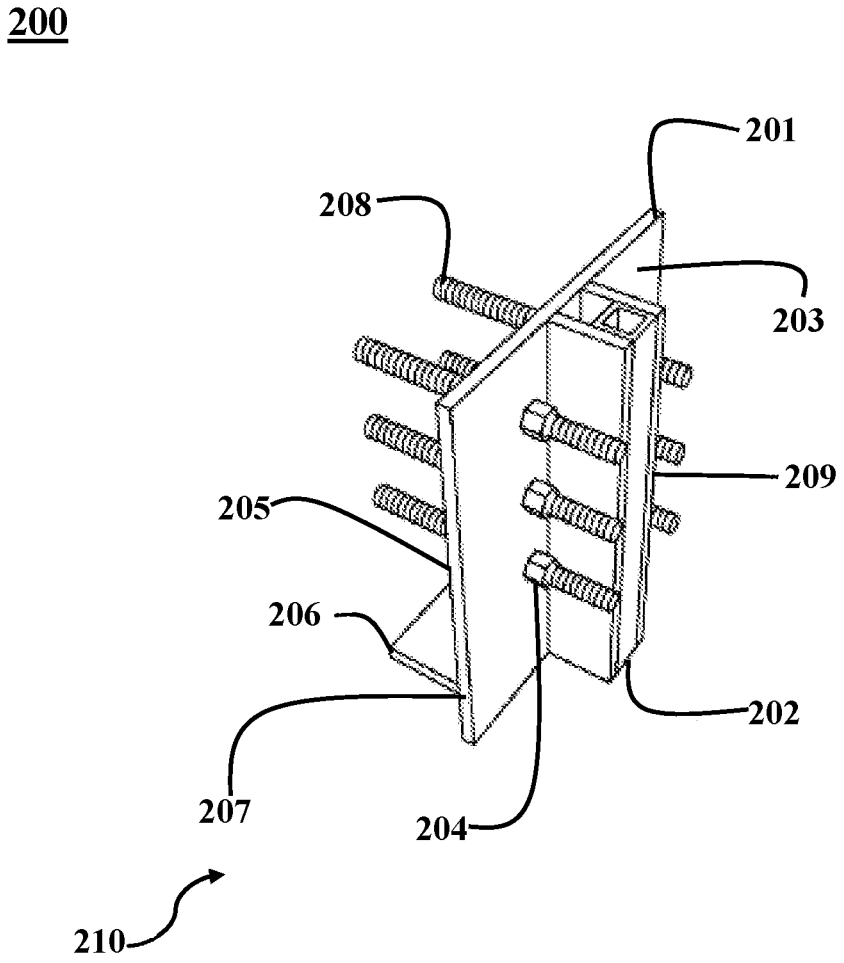
FIG. 2A illustrate a perspective view of a shear plate, consistent with one or more exemplary embodiments of the present disclosure.

FIG. 2A illustrates a perspective view 200 of shear plate 210, consistent with one or more exemplary embodiments of the present disclosure. In an exemplary embodiment, shear plate 210 may include a perforated plate 201, tie rods 208, nuts 204, fixing plate 206, two supporting plates 209, and a hollow rectangular prism 202. In an exemplary embodiment, perforated plate 201 may include at least six holes for placing six tie rods 208. In an exemplary embodiment, lateral side 207 of perforated plate 201 may have a length equal to a thickness of foundation 108. In an exemplary embodiment, shear plate 210 may include at least six nuts 204. In an exemplary embodiment, at least six tie rods 208 may be fastened on perforated plate 201 using at least six corresponding nuts 204. In an exemplary embodiment, at least six tie rods 208 may be threaded. In an exemplary embodiment, fixing plate 206 may be attached on back side 205 of perforated plate 201. In an exemplary embodiment, fixing plate 206 may be welded to back side 205 of perforated plate 201. In an exemplary embodiment, an exemplary back o side 205 of perforated plate 201 may face foundation 108. In an exemplary embodiment, at least six nuts 204 may be placed on at least six tie rods 208. In an exemplary embodiment, nut 204 may have a threaded hole. In an exemplary embodiment, tie rods 208 may be threaded. In an exemplary embodiment, at least six nuts 204 may be fastened on tie rods 208 from front side 203 of perforated plate 201. In an exemplary embodiment, shear plate 210 may be made of steel.

Figure 2B:
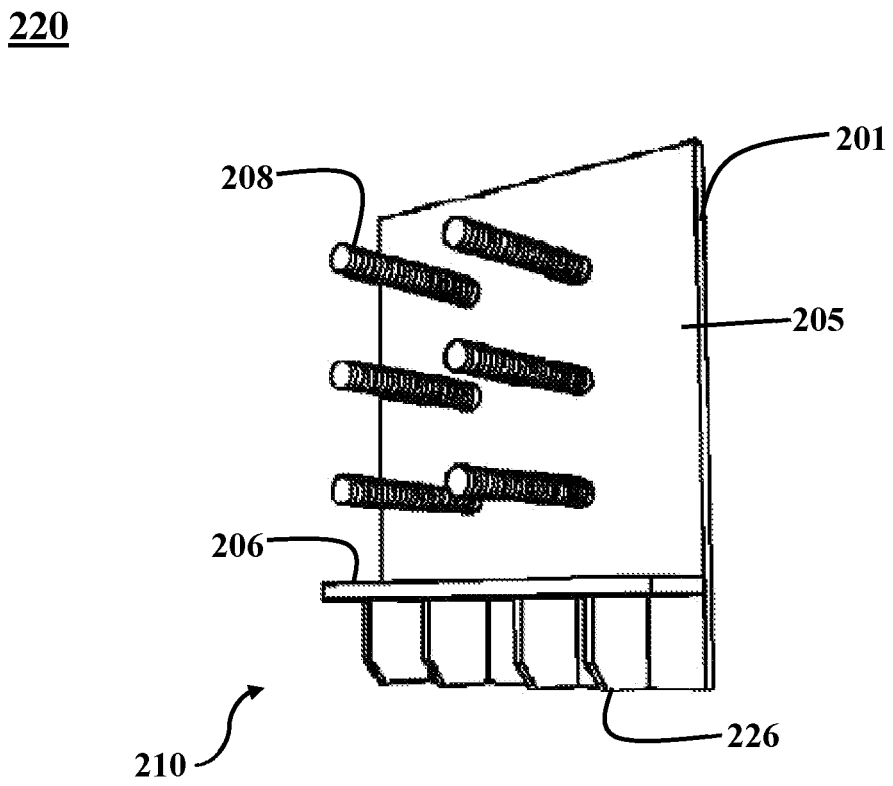
FIG. 2B illustrates a perspective back-side view of an exemplary shear plate, consistent with one or more exemplary embodiments of the present disclosure.

FIG. 2B illustrates a perspective back-side view 220 of shear plate 210, consistent with one or more exemplary embodiments of the present disclosure. In an exemplary embodiment, shear plate 221 may include a perforated plate 201, at least six tie rods 208, a fixing plate 206, and a plurality of reinforcement plates 226. In an exemplary embodiment, shear plate 210 may be made of steel. In an exemplary embodiment, at least six tie rods 208 may be threaded. In an exemplary embodiment, fixing plate 206 may be placed on back side 205 of shear plate 210. In an exemplary embodiment, at least four reinforcement plates 226 may be placed on bottom of fixing plate 206 facing foundation 108. In an exemplary embodiment, fixing plate 206 may be placed beneath foundation 108. In an exemplary embodiment, at least four reinforcement plate 226 may be placed on back side 205 of shear plate 210. In an exemplary embodiment, tie rods 208 may be structurally and functionally similar to tie rods 117.

Figure 2C:
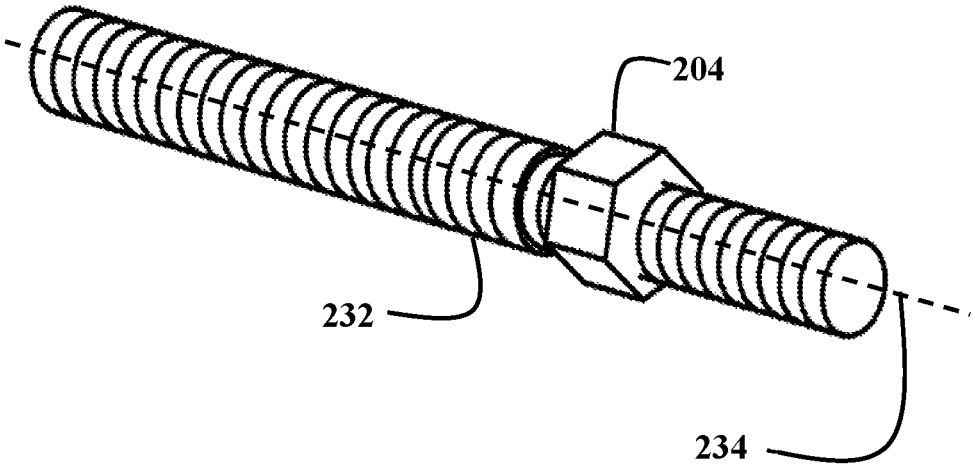
FIG. 2C illustrates a perspective view of a tie rod, consistent with one or more exemplary embodiments of the present disclosure.

FIG. 2C illustrates a perspective view 230 of tie rod 232, consistent with one or more exemplary embodiments of the present disclosure. In an exemplary embodiment, tie rod 232 may be threaded. In an exemplary embodiment, tie rod 232 may have a length in a range of 25 cm to 45 cm relative to longitudinal axis 234. In an exemplary embodiment, tie rod 232 may have a diameter in a range of 28 mm to 32 mm. In an exemplary embodiment, tie rod 232 may be made of steel. In an exemplary embodiment, nut 204 may be fastened on tie rod 232. In an exemplary embodiment, tie rod 232 may be structurally and functionally similar to tie rod 208.

Figure 2D:
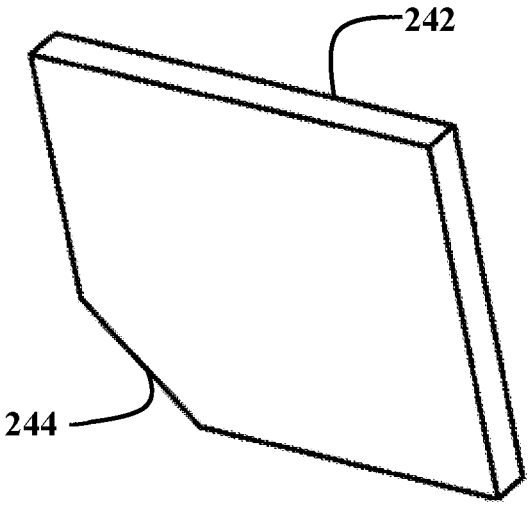
FIG. 2D illustrates a perspective view of a reinforcement plate, consistent with one or more exemplary embodiments of the present disclosure.

FIG. 2D illustrates a perspective view 240 of reinforcement plate 242, consistent with one or more exemplary embodiments of the present disclosure. In an exemplary embodiment, reinforcement plate 242 may include at least a rectangular structure, a square structure, and combinations thereof. In an exemplary embodiment, reinforcement plate 206 may include one side with a diagonal cut 244. In an exemplary embodiment, diagonal cut 244 may be placed next to a foundation, for example foundation 108 of FIGS. 1A-1C. In an exemplary embodiment, reinforcement plate 242 may be made of steel. In an exemplary embodiment, reinforcement plate 242 may be structurally and functionally similar to reinforcement plate 226.

Figure 2E:
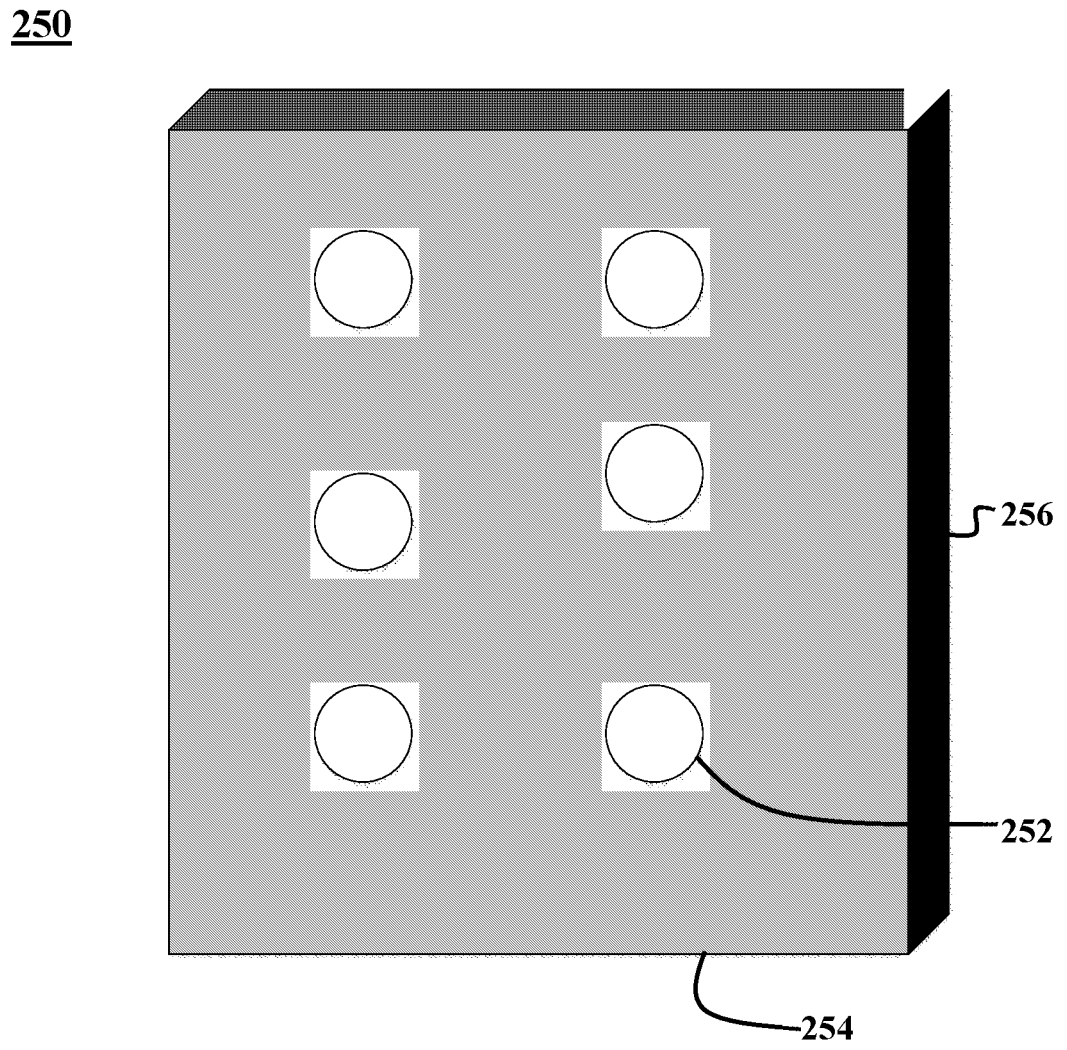
FIG. 2E illustrates a perspective view of a perforated plate, consistent with one or more exemplary embodiments of the disclosure.

FIG. 2E illustrates a perspective view 250 of perforated plate 254, consistent with one or more exemplary embodiments of the disclosure. In an exemplary embodiment, perforated plate 254 may include a quadrilateral structure with at least six holes. In an exemplary embodiment, a length of side 256 of perforated plate 254 may be equal to a thickness of a foundation, for example foundation 108 of FIGS. 1A-1C. In an exemplary embodiment, perforated plate 254 may be structurally and functionally similar to perforated plate 201.

Figure 2F:
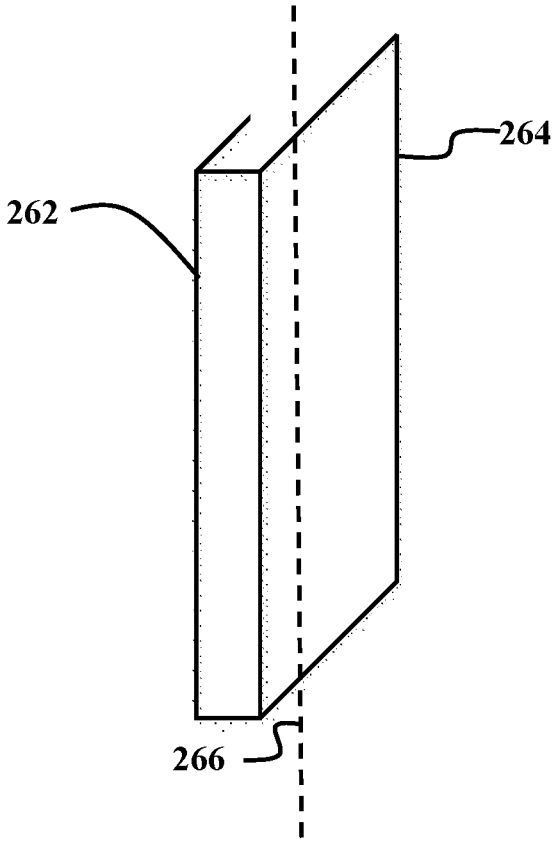
FIG. 2F illustrates a supporting plate of an exemplary shear plate, consistent with one or more exemplary embodiments of the present disclosure.

FIG. 2F illustrates a supporting plate 264 of shear plate 221, consistent with one or more exemplary embodiments of the present disclosure. In an exemplary embodiment, supporting plate 264 may have a length relative to longitudinal axis 266 equal to a thickness of a foundation for example foundation 108 of FIGS. 1A-1C. In an exemplary embodiment, supporting plate 264 may be attached to perforated plate 201 from side 262. In an exemplary embodiment, supporting plate 264 may be welded to perforated plate 201. In an exemplary embodiment, supporting plate 264 may be made of steel. In an exemplary embodiment, supporting plate 264 may be structurally and functionally similar to supporting plate 209 of FIG. 2A. In an exemplary embodiment, shear plate 210 may include two supporting plates 264. In an exemplary embodiment, two supporting plates 264 may have a distance from each other in a range of 6 cm to 8 cm.

Figure 2G:
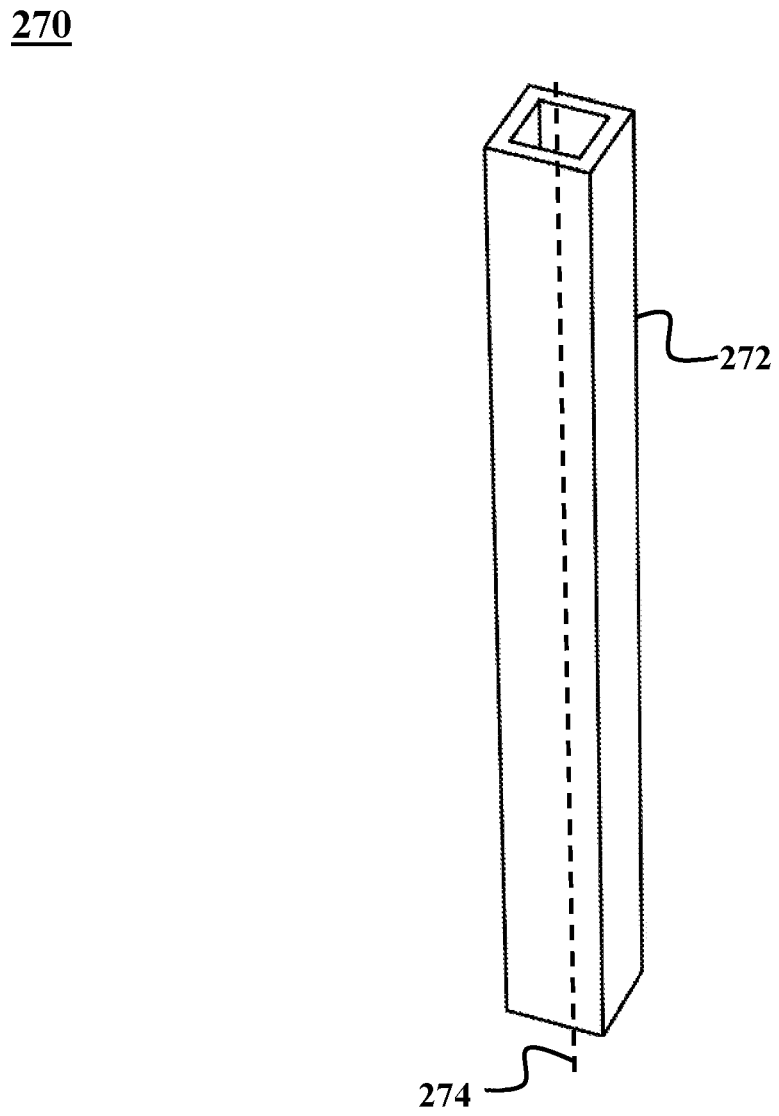
FIG. 2G illustrates a hollow rectangular prism of an exemplary shear plate, consistent with one or more exemplary embodiments of the present disclosure.

FIG. 2G illustrates a hollow rectangular prism 272 of shear plate 221, consistent with one or more exemplary embodiments of the present disclosure. In an exemplary embodiment, hollow rectangular prism 272 may have a length along with longitudinal axis 274 in a range of 65 cm to 140 cm. In an exemplary embodiment, longitudinal axis 274 may be parallel with longitudinal axis 266. In an exemplary embodiment, hollow rectangular prism 272 may be structurally and functionally similar to hollow rectangular prism 202. In an exemplary embodiment, hollow rectangular prism 272 may be placed inside two supporting plates 209. In an exemplary embodiment, hollow rectangular prism 272 may be movable inside supporting plates 209.

Figure 3A:
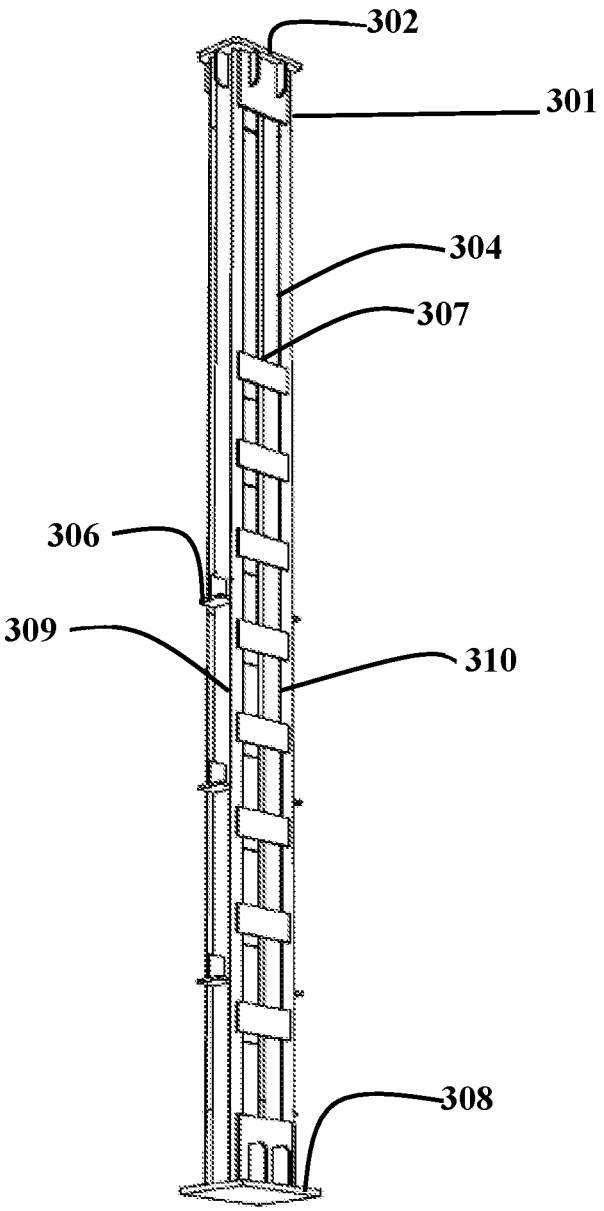
FIG. 3A illustrates a perspective view of a pressure transfer column, consistent with one or more exemplary embodiments of the present disclosure.

FIG. 3A illustrates a perspective view 300 of pressure transfer column 301, consistent with one or more exemplary embodiments of the present disclosure. In an exemplary embodiment, pressure transfer column 301 may be structurally and functionally similar to pressure transfer column 125 of FIGS. 1A-1C described herein above. In an exemplary embodiment, pressure transfer column 301 may include a bottom stiffening plate 308, a top stiffening plate 302, a double column 304, a plurality of parallel clamps 307, and a shear connection 306. In an exemplary embodiment, top stiffening plate 302 may be attached to top of double column 304. In an exemplary embodiment, top stiffening plate 302 may be welded to double column 304. In an exemplary embodiment, bottom stiffening plate 308 may be attached to bottom of double column 304. In an exemplary embodiment, bottom stiffening plate 308 may be welded to double column 304. In an exemplary embodiment, double column 304 may include a first column 309 and a second column 310. In an exemplary embodiment, an exemplary plurality of parallel clamps 307 may attach first column 309 and second column 310 together. In an exemplary embodiment, shear connection 306 may be attached to at least one side of double column 304. In an exemplary embodiment, pressure transfer column 301 may include a plurality of shear connections 306. In an exemplary embodiment, shear connection 306 may help pressure transfer column 301 to be fixed in cemented gravel layer 112. In an exemplary embodiment, top stiffening plate 302 may be structurally and functionally similar to top stiffening plate 103. In an exemplary embodiment, bottom stiffening plate 308 may be structurally and functionally similar to bottom stiffening plate 116. In an exemplary embodiment, parallel clamps 307 may be structurally and functionally similar to parallel clamps 123. In an exemplary embodiment, double column 304 may be structurally and functionally similar to double column 125. In an exemplary embodiment, shear connection 306 may be structurally and functionally similar to shear connection 114.

Figure 3B:
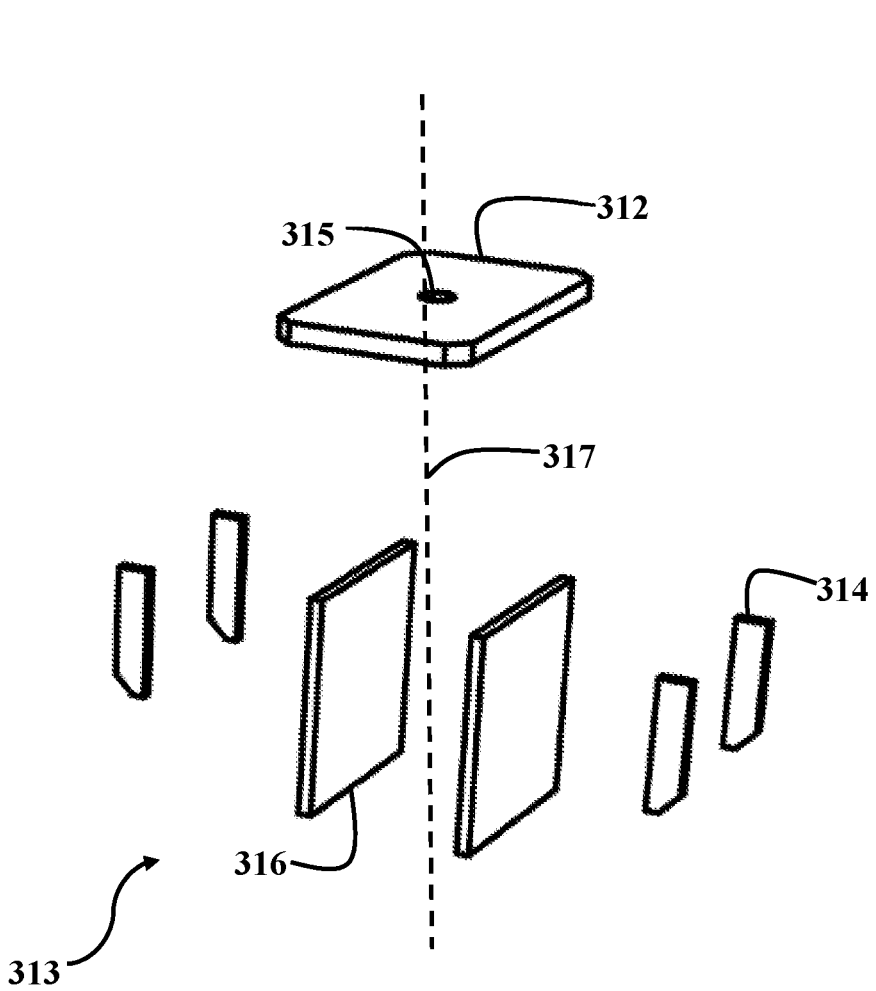
FIG. 3B illustrates a perspective view of a top stiffening plate, consistent with one or more exemplary embodiments of the present disclosure.

FIG. 3B illustrates a perspective view 311 of top stiffening plate 313, consistent with one or more exemplary embodiments of the present disclosure. In an exemplary embodiment, top stiffening plate 313 may include a first plate 312, a second plate 316, and fixing component 314. In an exemplary embodiment, first plate 312 may include a central hole 315. In an exemplary embodiment, central hole 315 may be used to pass tensile shaft 101 of tensile system 102. In an exemplary embodiment, first plate 312 may be attached horizontally relative to a longitudinal axis 317 to two second plates 316. In an exemplary embodiment, first plate 312 may be welded to two second plates 316. In an exemplary embodiment, at least four fixing components 314 may be attached to two second plates 316. In an exemplary embodiment, fixing components 314 may be welded to two second plates 316. In an exemplary embodiment, top stiffening plate 313 may be structurally and functionally similar to top stiffening plate 103.

Figure 3C:
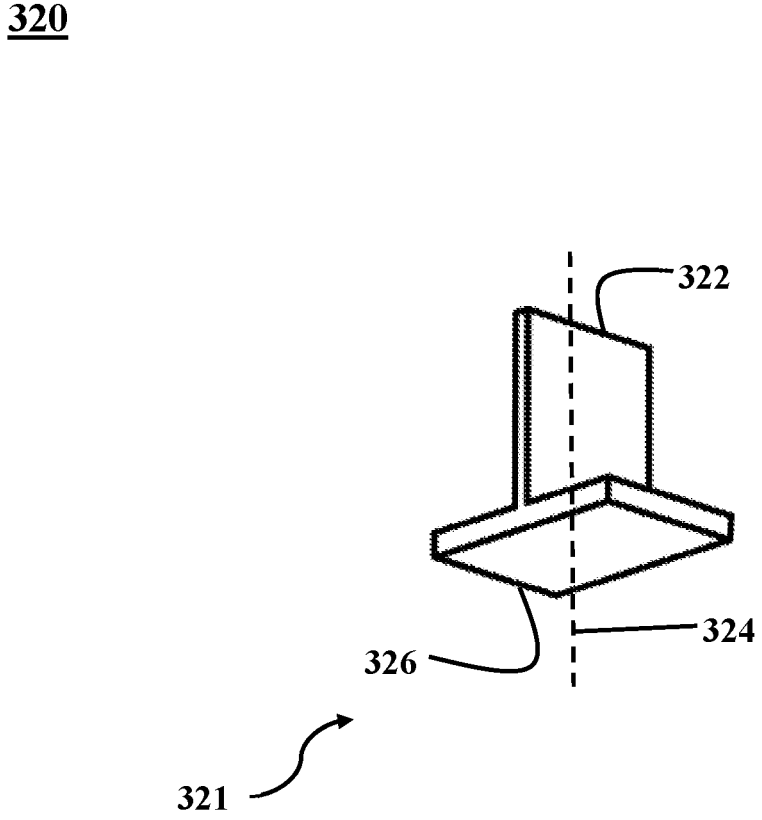
FIG. 3C illustrates a perspective view of a shear connection, consistent with one or more exemplary embodiments of the present disclosure.

FIG. 3C illustrates a perspective view 320 of shear connection 321, consistent with one or more exemplary embodiments of the present disclosure. In an exemplary embodiment, shear connection 321 may include a horizontal plate 326 attached to a vertical plate 322 with 90 degree difference between horizontal plate 326 and vertical plate 322. In an exemplary embodiment, horizontal plate 326 may be welded to vertical plate 322. In an exemplary embodiment, horizontal plate 326 may be horizontal relative to longitudinal axis 324. In an exemplary embodiment, vertical plate 322 may be vertical relative to longitudinal axis 324. In an exemplary embodiment, shear connection 321 may be attached to double column 125. In an exemplary embodiment, shear connection 321 may be welded to double column 125. In an exemplary embodiment, a plurality of shear connections 321 may be attached to double column 125. In an exemplary embodiment, longitudinal axis 324 may have 90 degree difference with longitudinal axis 317. In an exemplary embodiment, shear connection 321 may be structurally and functionally similar to shear connection 114.

Figure 3D:
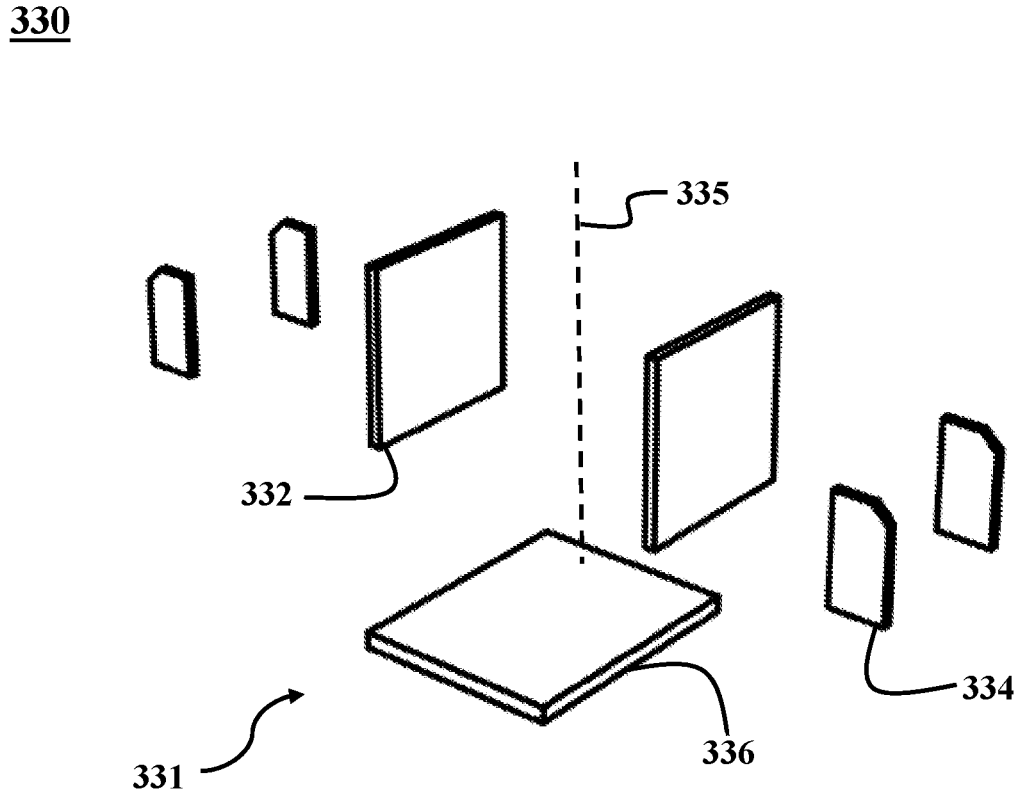
FIG. 3D illustrates a perspective view of a bottom stiffening plate, consistent with one or more exemplary embodiments of the present disclosure.

FIG. 3D illustrates a perspective view 330 of bottom stiffening plate 331, consistent with one or more exemplary embodiments of the present disclosure. In an exemplary embodiment, bottom stiffening plate 331 may include first plate 332, second plate 336, and fixing plates 334. In an exemplary embodiment, two first plates 332 may be attached to one second plate 336 with 90 degree difference between first plates 332 and second plate 336 relative to longitudinal axis 335 of bottom stiffening plate 331. In an exemplary embodiment, bottom stiffening plate 331 may include at least four fixing plates 334. In an exemplary embodiment, fixing plates 334 may be welded to bottom stiffening plate 331. In an exemplary embodiment, fixing plates 334 may fix first plates 332 to second plate 336. In an exemplary embodiment, first plate 332 may be parallel with longitudinal axis 335 of bottom stiffening plate 331. In an exemplary embodiment, second plate 336 may be vertical relative to longitudinal axis 335 of bottom stiffening plate 331.

Figure 4A:
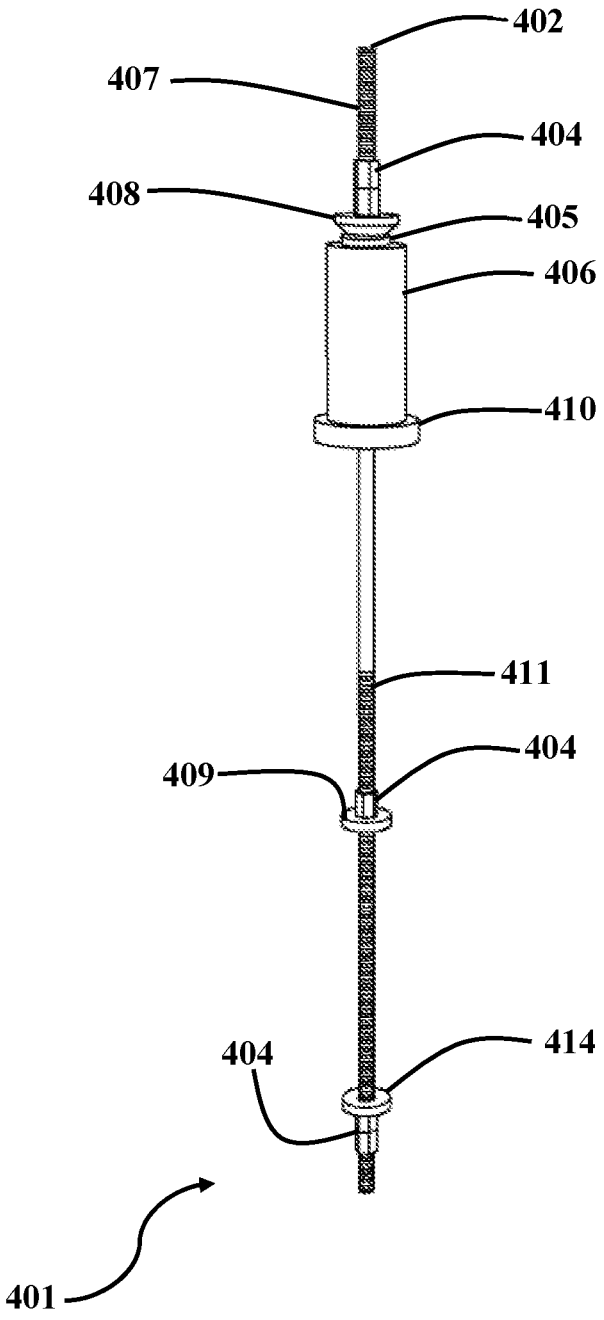
FIG. 4A illustrates a tensile system, consistent with one or more exemplary embodiments of the present disclosure.

FIG. 4A illustrates a view 400 of tensile system 401, consistent with one or more exemplary embodiments of the present disclosure. In an exemplary embodiment, tensile system 401 may include a tensile shaft 402, a plurality of nuts 404, a disc 408, a jack 406, a bottom ring 414, and an upper ring 409, a jack bottom ring 410, a jack upper ring 405. In an exemplary embodiment, tensile shaft 402 may include a shaft with two threaded ends. In an exemplary embodiment, jack 406 may be a hydraulic jack. In an exemplary embodiment, jack 406 may contain a fluid. In an exemplary embodiment, an exemplary fluid may be oil. In an exemplary embodiment, jack upper ring 405 may be placed on top of jack 406. In an exemplary embodiment, disc 408 may be placed on top of jack upper ring 405. In an exemplary embodiment, jack bottom ring 410 may be placed on bottom of jack 406. In an exemplary embodiment, at least two nuts 404 may be fastened on first threaded end 407 of tensile shaft 402. In an exemplary embodiment, nut 404 and upper ring 409 may be fixed on a second threaded end 411 of tensile shaft 402. In an exemplary embodiment, bottom ring 414 may passed through second threaded end 411 of tensile shaft 402. In an exemplary embodiment, at least two nuts 404 may fix bottom ring 414 on tensile shaft 402. In an exemplary embodiment, upper ring 409 and bottom ring 414 may face each other. In an exemplary embodiment, tensile shaft 402 may pass through central hole 315 of top stiffening plate 311. In an exemplary embodiment, jack bottom ring 410 may be placed on top stiffening plate 311. In an exemplary embodiment, upper ring 409 may be placed on top of hollow rectangular prism 202. In an exemplary embodiment, tensile shaft 402 may pass through hollow rectangular prism 202. In an exemplary embodiment, bottom ring 414 may be placed on bottom of hollow rectangular prism 202.

Figure 4B:
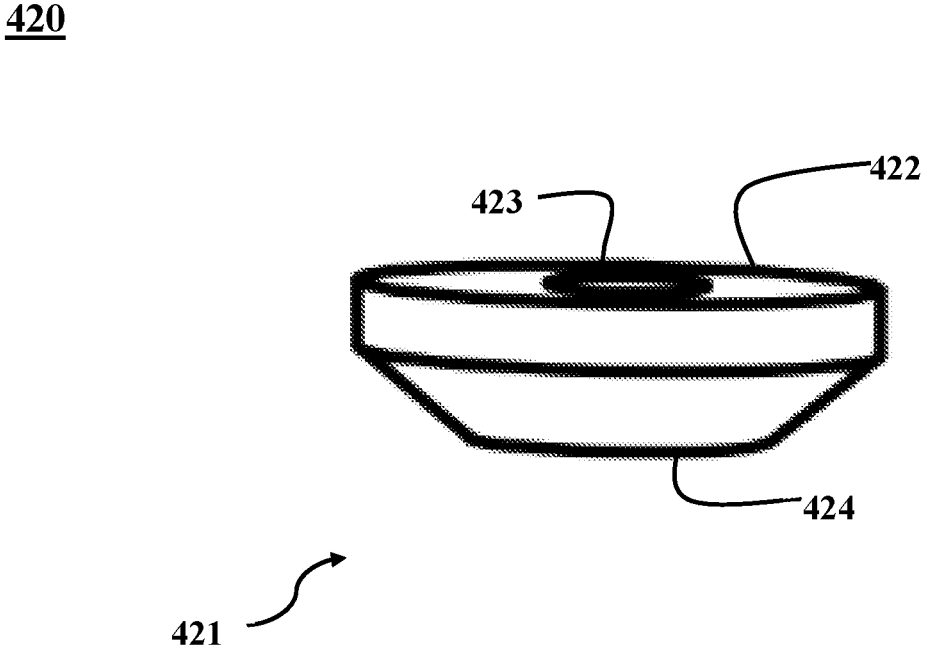
FIG. 4B illustrates a disc, consistent with one or more exemplary embodiments of the present disclosure.

FIG. 4B illustrates a view 420 of disc 421, consistent with one or more exemplary embodiments of the present disclosure. In an exemplary embodiment, disc 421 may include a isoscale trapezoid shape. In an exemplary embodiment, disc 421 may include unequal opposite first side 422 and second side 424 (bases). In an exemplary embodiment, second side 424 of disc 421 may face jack upper ring 405. In an exemplary embodiment, disc 421 may include a disc central hole 423 for passing tensile shaft 402. In an exemplary embodiment, disc 421 may be structurally and functionally similar to disc 408.

Figure 5A:
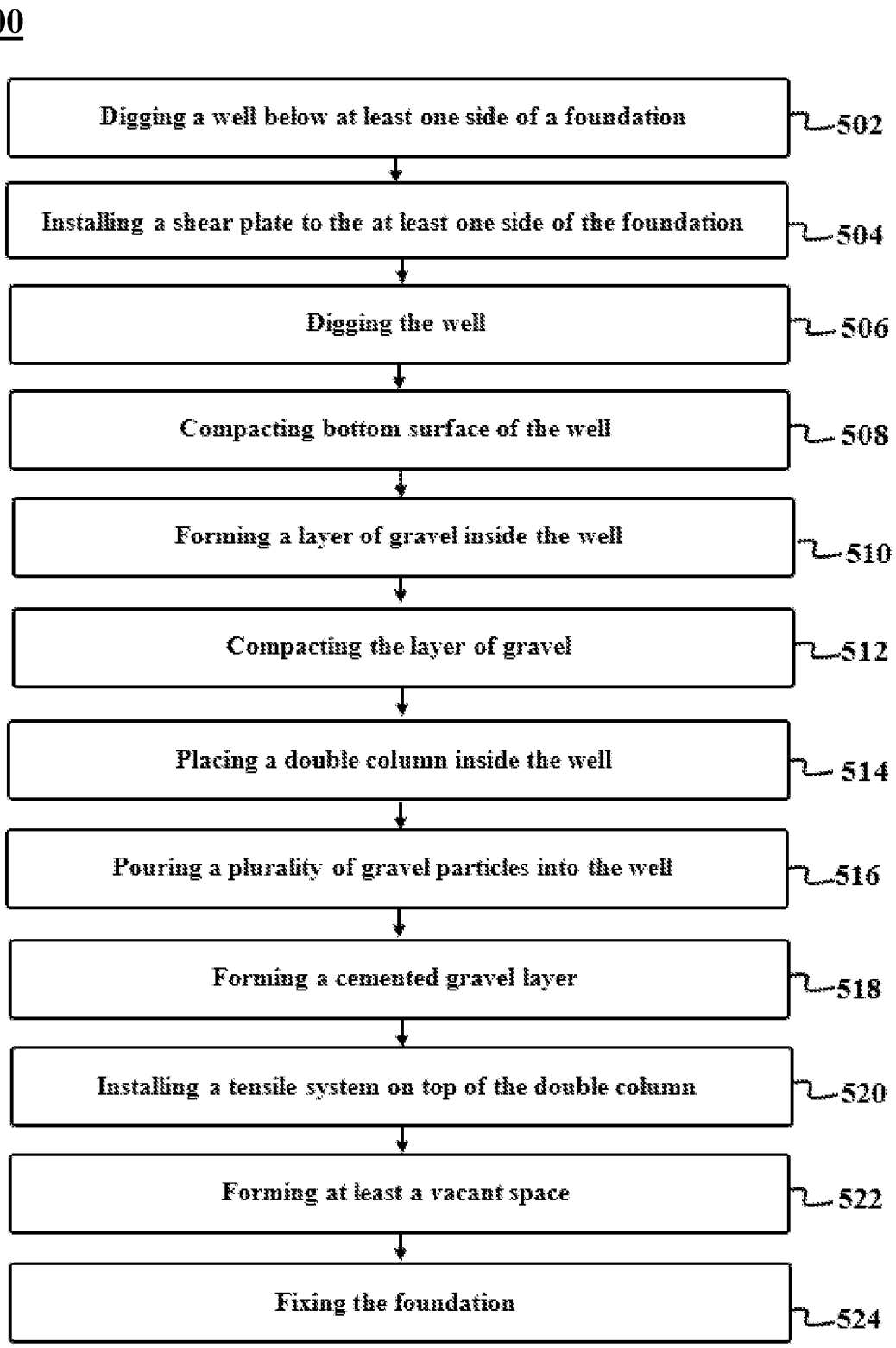
FIG. 5A illustrates a flowchart of a method for lifting and repairing a foundation, consistent with one or more exemplary embodiments of the present disclosure.

In an exemplary embodiment, methods of lifting and repairing a foundation using a device similar to device 101 are described. FIG. 5A illustrates a flowchart of a method 500 for lifting and repairing foundation 108, consistent with one or more exemplary embodiments of the present disclosure. In an exemplary embodiment, method 500 may include a step 502 of digging a well below at least one side of a foundation, a step 504 of installing a shear plate to the at least one side of the foundation, a step 506 of further digging the well, a step 508 of compacting a bottom surface of the well, a step 510 of forming a layer of gravel inside the well, a step 512 of compacting the layer of gravel, a step 514 of placing a double column inside the well, a step 516 of pouring a plurality of gravel particles into the well, a step 518 of forming a cemented gravel layer, a step 520 of installing a tensile system on top of the double column, a step 522 of forming at least a vacant space, and a step 524 of fixing the foundation. In an exemplary embodiment, an exemplary foundation may be structurally and functionally similar to foundation 108 of FIGS. 1A-1C that may be lifted and repaired by method 500 utilizing an exemplary device similar to device 104 of FIG. 1A. So, exemplary method 500 is described herein below in connection with FIGS. 1A-4B described herein above.

In further detail with respect to step 502, step 502 of digging a well may include digging well 119 below at least one lateral surface 136 of foundation 108. In an exemplary embodiment, an exemplary well may be a hole dug in a ground. In an exemplary embodiment, an exemplary well may have a diameter in a range of 1 m to 1.5 m. In an exemplary embodiment, well 119 may have a depth equal to a thickness of foundation 118. In an exemplary embodiment, a part of foundation 108 may cover at least one third of opening 137 of well 119. In an exemplary embodiment, digging an exemplary well below the at least one lateral surface 136 of foundation 108 may include digging an exemplary well in which at least 30 cm of opening 137 of well 119 may be covered by a part of foundation 108. In an exemplary embodiment, an exemplary well may be dug by at least a human, a mechanical instrument, and combinations thereof. In an exemplary embodiment, an exemplary well may be dug below at least one side of foundation 108.

In further detail with respect to step 504, step 504 of installing a shear plate to the at least one side of foundation 108 may include installing shear plate 106 to at least one lateral surface 136 of foundation 108. In an exemplary embodiment, shear plate 106 may be installed on lateral surface 136 of foundation 108 in which shear plate 106 may be inside opening 137 of well 119. In an exemplary embodiment, fixing plate 206 of shear plate 106 may be placed below foundation 108. In an exemplary embodiment, tensile system 401 may lift foundation 108 using fixing plate 206. In an exemplary embodiment, installing shear plate 106 on an exemplary at least one lateral surface 136 of foundation 108 may include inserting at least six tie rods 232 into foundation 108. In an exemplary embodiment, an exemplary plurality of tie rods 117 may be inserted into lateral surface 136 of foundation 108 (as shown in FIG. 1A). In an exemplary embodiment, an exemplary at least six tie rods 232 may be threaded. In an exemplary embodiment, tensile system 401 may lift foundation 108 using at least six tie rods 232 inserted into lateral surface 136 of foundation 108. In an exemplary embodiment, a length of lateral surface 256 of perforated plate 254 may be equal to a thickness of foundation 108.

In further detail with respect to step 506, step 506 of further digging an exemplary well may include digging an exemplary well to a depth in a range of 2 m to 6 m. In an exemplary embodiment, an exemplary well may be dug by at least a human, a mechanical instrument, and combinations thereof.

In further detail with respect to step 508, step 508 of compacting an exemplary a bottom surface of well 119 may include compacting an exemplary bottom surface of well 119 using a dynamic hammer in a vertical direction. In an exemplary embodiment, compacting an exemplary bottom surface of well 119 may include dynamically hammering an exemplary bottom surface of well 119 with a power of an exemplary dynamic hammer in a range of 800 blow per minute to 1100 blow per minute in a vertical direction. In an exemplary embodiment, compacting an exemplary bottom surface of well 119 may include hammering an exemplary bottom surface of well 119 using a hammer with a weight of an exemplary hammer in a range of 30 kg to 50 kg. In an exemplary embodiment, an exemplary hammer may be an electric hammer.

In further detail with respect to step 510, step 510 of forming a layer of gravel inside an exemplary well may include pouring a first plurality of gravel particles inside an exemplary well. In an exemplary embodiment, forming an exemplary layer of gravel inside an exemplary well may include forming an exemplary layer of gravel with a thickness in a range of 20 cm to 80 cm. In an exemplary embodiment, each particle of an exemplary first plurality of gravel particles may have an average particle size in a range of 12 mm to 38 mm.

In further detail with respect to step 512, step 512 of compacting an exemplary layer of gravel may include compacting an exemplary layer of gravel using a dynamic hammer in a vertical direction. In an exemplary embodiment, an exemplary layer of gravel may be compacted to a thickness in a range of 20 cm to 80 cm. In an exemplary embodiment, a spherical shape of a compacted gravel layer may form on a bottom of well 119 due to compacting an exemplary layer of gravel. In an exemplary embodiment, compacting an exemplary layer of gravel may include hammering an exemplary layer of gravel using a hammer with a weight of an exemplary hammer in a range of 30 kg to 50 kg. In an exemplary embodiment, an exemplary hammer may be an electric hammer. In an exemplary embodiment, compacting an exemplary layer of gravel may include hammering an exemplary layer of gravel using an exemplary hammer with a speed of hammering in a range of 800 blow per minute to 1100 blow per minute in a vertical direction. In an exemplary embodiment, hammering an exemplary layer of an exemplary gravel may include hammering an exemplary layer of an exemplary gravel using an electric hammer.

In further detail with respect to step 514, step 514 of placing a double column inside well 119 may include placing pressure transfer column 301 inside well 119. In an exemplary embodiment, bottom stiffening plate 308 may be placed on an exemplary compacted layer of gravel. In an exemplary embodiment, pressure transfer column 301 may be fixed inside an exemplary well by fixing pressure transfer column 301 to shear plate 106 using at least six tie rods 208. In an exemplary embodiment, an exemplary at least six tie rods 208 may be placed between two supporting plates 209.

In further detail with respect to step 516, step 516 of pouring a second plurality of gravel particles into well 119 may include pouring an exemplary second plurality of gravel particles into well 119 to a maximum height of an exemplary plurality of gravel particles up to 70 cm beneath foundation 108. In an exemplary embodiment, pouring an exemplary second plurality of gravel particles may include pouring an exemplary second plurality of gravel particles with a distance up to 70 cm between a top surface of an exemplary second plurality of gravel particles and foundation 108. In an exemplary embodiment, each particle of an exemplary second plurality of gravel particles may have an average particle size in a range of 12 mm to 38 mm. In an exemplary embodiment, an exemplary second plurality of gravel particles may fill around double column 125 in well 119.

In further detail with respect to step 518, step 518 of forming a cemented gravel layer may include injecting a first amount of cement slurry into an exemplary well to fill empty spaces among an exemplary second plurality of gravel particles. In an exemplary embodiment, injecting an exemplary first amount of cement slurry into well 110 may include injecting an exemplary first amount of cement slurry with a pressure in a range of 1 bar to 2 bar. In an exemplary embodiment, an exemplary cemented gravel layer may form after solidifying an exemplary first amount of cement slurry. In an exemplary embodiment, an exemplary first amount of cement slurry may be directly proportional to a volume of empty spaces among an exemplary second plurality of gravel particles. In an exemplary embodiment, for example, an exemplary first amount of cement slurry may increase by increasing an exemplary volume of empty spaces among an exemplary second plurality of gravel particles. In an exemplary embodiment, an exemplary first amount of cement slurry may be also directly proportional to an exemplary average particle size of an exemplary second plurality of gravel particles. In an exemplary embodiment, for example, an exemplary first amount of cement slurry may increase by increasing an exemplary average particle size of an exemplary second plurality of gravel particles.

In further detail with respect to step 520, step 520 of installing a tensile system on top of double column 125 may include installing tensile system 401 on top stiffening plate 313. In an exemplary embodiment, installing tensile system 401 may include passing tensile shaft 402 through central hole 315 of top stiffening plate 313. In an exemplary embodiment, tensile shaft 402 may pass through hollow rectangular prism 272. In an exemplary embodiment, upper ring 409 may be fixed on top of hollow rectangular prism 272. In an exemplary embodiment, after passing tensile shaft 402 through hollow rectangular prism 272, bottom ring 414 may be fastened on second threaded end 411 of tensile shaft 402. In an exemplary embodiment, after fastening bottom ring 414 on tensile shaft 402, an exemplary at least two nuts 404 may be fastened on tensile shaft 402.

In further detail with respect to step 522, step 522 of forming at least a vacant space between foundation 108 and ground may include lifting foundation 108 using tensile system 401 from an exemplary ground below foundation 108. In an exemplary embodiment, lifting foundation 108 from one lateral surface 136 of foundation 108 may form one exemplary vacant space between an exemplary ground and foundation 108. In an exemplary embodiment, a volume of an exemplary vacant space may be directly proportional to a height that foundation 108 may be lifted from an exemplary ground. In an exemplary embodiment, for example, increasing an exemplary height of foundation 108 from an exemplary ground may increase an exemplary volume of an exemplary vacant space between foundation 108 and an exemplary ground. In an exemplary embodiment, lifting foundation 108 may include lifting foundation 108 from at least one side of foundation 108. In an exemplary embodiment, foundation 108 may be lifted from at least two sides simultaneously. In an exemplary embodiment, foundation 108 may be lifted from at least two sides respectively. In an exemplary embodiment, after lifting foundation 108 using tensile system 401, at least a vacant space may form between an exemplary cemented gravel layer and foundation 108. In an exemplary embodiment, tensile system 401 may lift shear plate 106. In an exemplary embodiment, shear plate 106 may be attached to foundation 108 via at least six tie rods 232. In an exemplary embodiment, lifting shear plate 106 using tensile system 401 may lift foundation 108.

Figure 5B:
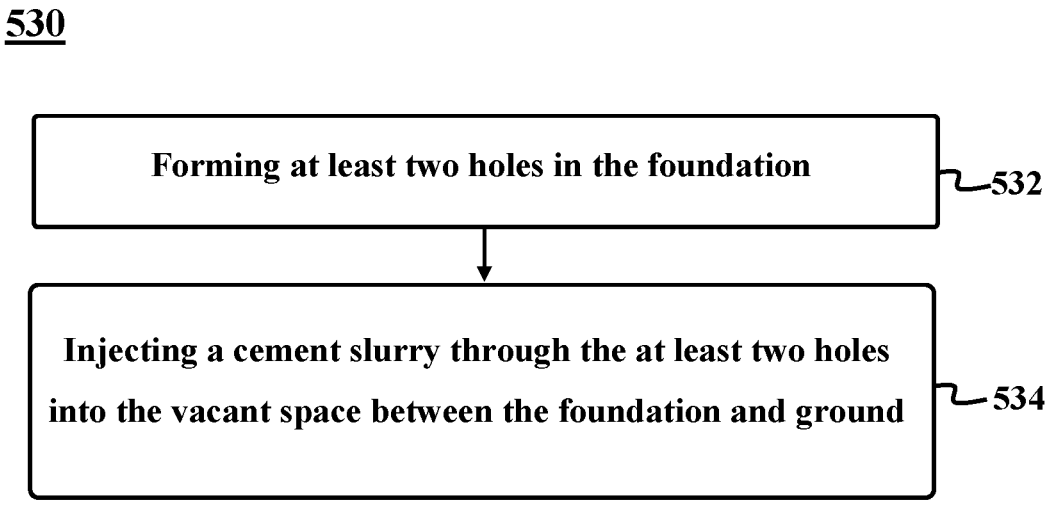
FIG. 5B illustrates a flowchart of a method for fixing an exemplary foundation, consistent with one or more exemplary embodiments of the present disclosure.

In further detail with respect to step 524, step 524 of fixing foundation 108 may include injecting a second amount of cement slurry into an exemplary vacant space between foundation 108 and an exemplary ground below foundation 108. In an exemplary embodiment, an exemplary second amount of cement slurry may be injected into an exemplary at least a vacant space to fill an exemplary vacant space. In an exemplary embodiment, fixing foundation 108 may be illustrated using FIG. 5B. FIG. 5B illustrates a flowchart of a method 530 for fixing foundation 108, consistent with one or more exemplary embodiments of the present disclosure. In an exemplary embodiment, method 530 may include a step 532 of forming at least two holes in the foundation, and a step 534 of injecting a cement slurry through the at least two holes into the vacant space between the foundation and an exemplary ground below foundation 108.

In further detail with respect to step 532, step 532 of forming at least two holes in foundation 108 may include forming an exemplary at least two holes with a depth equal to a thickness of foundation 108. In an exemplary embodiment, at least two holes may be formed for one vacant space. In an exemplary embodiment, an exemplary at least two holes may form in foundation 108 using at least a human, a mechanical instrument, and combinations thereof.

In further detail with respect to step 534, step 534 of injecting a cement slurry through the at least two holes into the vacant space between an exemplary cemented gravel layer and foundation 108 may include injecting an exemplary second amount of cement slurry through an exemplary at least two holes by at least a mechanical instrument, a human, and combinations thereof. In an exemplary embodiment, an exemplary second amount of cement slurry may be injected through an exemplary at least two holes for each vacant space. In an exemplary embodiment, an exemplary second amount of cement slurry may fill an exemplary at least a vacant space between an exemplary cemented gravel layer and foundation 108. In an exemplary embodiment, tensile system 401 may be detached from device 101 after aligning foundation 108. In an exemplary embodiment, aligning foundation 108 may refer to lifting foundation 108 from at least one side of foundation 108 to place foundation 108 on a level without a slope. In an exemplary embodiment, device 101 may be used for multiple times. In an exemplary embodiment, pressure transfer column 125 and shear plate 106 may remain in ground for future use. In an exemplary embodiment, for fixing foundation 108, a third plurality of gravel particles may be poured into an exemplary well. In an exemplary embodiment, an exemplary third plurality of gravel particles may fill an exemplary well. In an exemplary embodiment, a third amount of cement slurry may be injected into an exemplary third plurality of gravel particles.

The embodiments have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for description and not of limitation, such that the terminology or phraseology of the present specification is to be interpreted by the skilled artisan in light of the teachings and guidance.

The breadth and scope of the present disclosure should not be limited by any of the above-described exemplary embodiments but should be defined only in accordance with the following claims and their equivalents.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially planar is intended to mean planar, nearly planar and/or exhibiting characteristics associated with a planar element. Further use of relative terms such as "vertical", "horizontal", "up", "down", and "side-to-side" are used in a relative sense to the normal orientation of the apparatus.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A method for lifting and repairing a foundation, comprising:

digging a well below at least one lateral surface of the foundation, at least one third of an opening of the well being covered by a part of the foundation;

installing a shear plate to the at least one lateral surface of the foundation inside the opening of the well;

further digging the well to a maximum depth of 6 m;

compacting a bottom surface of the well at the maximum depth of 6 m by dynamic hammering the bottom surface of the well;

forming a layer of gravel by pouring a first plurality of gravel particles inside the well;

compacting the layer of the gravel by dynamic hammering the layer of the gravel;

placing a double column inside the well, the double column being fixed to the shear plate;

pouring a second plurality of gravel particles into the well, the second plurality of gravel particles filling around the double column in the well;

forming a cemented gravel layer by injecting a first amount of cement slurry into the well to fill empty spaces among the second plurality of gravel particles;

installing a tensile system on top of the double column, the tensile system being fixed on the shear plate;

forming at least a vacant space between the foundation and ground by lifting the foundation from the ground using the tensile system; and fixing the foundation by injecting a second amount of cement slurry into the vacant space.

2. The method of claim 1, wherein fixing the foundation further comprises pouring a third plurality of gravel particles into the well, wherein the third plurality of particles fills the well.

3. The method of claim 2, wherein fixing the foundation further comprises pouring a third amount of cement slurry into the well, wherein the third amount of cement slurry fills empty spaces among the third plurality of gravel particles.

4. The method of claim 1, wherein digging the well below at least one lateral surface of the foundation comprises digging the well with a diameter in a range of 1 m to 1.5 m.

5. The method of claim 1, wherein digging the well below the at least one lateral surface of the foundation comprises digging the well wherein at least 30 cm of the opening of the well is covered by the part of the foundation.

6. The method of claim 1, wherein installing the shear plate comprises installing the shear plate to the at least one lateral surface of the foundation inside the opening of the well with a length of one lateral surface of the shear plate being equal to a thickness of the foundation.

7. The method of claim 1, wherein installing the shear plate to the at least one lateral surface of the foundation comprises inserting at least six tie rods of the shear plate into the foundation.

8. The method of claim 1, further comprising fixing the double column to the shear plate by welding the double column to the shear plate.

9. The method of claim 1, wherein forming the layer of gravel comprises pouring the first plurality of gravel particles inside the well with a thickness of the layer of gravel in a range of 20 cm to 80 cm.

10. The method of claim 1, wherein compacting the layer of the gravel comprises hammering the layer of the gravel using a hammer with a weight of the hammer in a range of 30 kg to 50 kg.

11. The method of claim 10, wherein compacting the layer of the gravel comprises hammering the layer of the gravel using the hammer with a speed of hammering in a range of 800 blow per minute to 1100 blow per minute.

12. The method of claim 11, wherein hammering the layer of the gravel comprises hammering the layer of the gravel using an electric hammer.

13. The method of claim 1, wherein placing the double column inside the well comprises placing the double column to the layer of the gravel and the shear plate using the cemented gravel layer filling around the double column, wherein the double column is made of steel.

14. The method of claim 1, wherein pouring the second plurality of gravel particles comprises pouring the second plurality of gravel particles with a distance up to 70 cm between a top surface of the second plurality of gravel particles and the foundation.

15. The method of claim 14, wherein each gravel particle of the second plurality of gravel particles has an average particle size in a range of 12 mm to 38 mm.

16. The method of claim 1, wherein installing the tensile system on top of the double column comprises installing a jack and a tensile shaft on top of the double column, wherein the tensile shaft is aligned parallel with the double column, wherein the tensile shaft is connected to the jack.

17. The method of claim 1, wherein injecting the second amount of cement slurry into the vacant space between the cemented gravel layer and the foundation comprises:

forming at least two holes in the foundation; and injecting the cement slurry through the at least two holes into the vacant space between the cemented gravel layer and the foundation.

18. The method of claim 1, wherein lifting the foundation comprises lifting the foundation from at least one lateral surface of the foundation.

* * * * *